US006969068B1

(12) United States Patent
Pollon et al.

(10) Patent No.: US 6,969,068 B1
(45) Date of Patent: Nov. 29, 2005

(54) APPARATUS FOR SUPPORTING SPORT PRACTICE TARGETS

(75) Inventors: Gregory Lorne Pollon, St. Albert (CA); Timothy Dale Stewart, St. Albert (CA)

(73) Assignee: Retract-A-Sport Inc., St. Albert (CA)

( * ) Notice: Subject to any disclaimer, the term of this patent is extended or adjusted under 35 U.S.C. 154(b) by 367 days.

(21) Appl. No.: 09/677,495

(22) Filed: Oct. 4, 2000

(30) Foreign Application Priority Data

Oct. 13, 1999 (CA) ..... 2285795

(51) Int. Cl.[7] ..... A63B 63/00
(52) U.S. Cl. ..... 273/400; 473/197; 473/476
(58) Field of Search ..... 473/446, 455, 473/456, 417, 197; 273/398–402, 376; 160/122, 160/23.1, 23

(56) References Cited

U.S. PATENT DOCUMENTS

| | | | | | |
|---|---|---|---|---|---|
| 1,746,723 | A | * | 2/1930 | Valentine | 160/267.1 |
| 4,057,252 | A | | 11/1977 | Pelton | 273/101 |
| 4,078,492 | A | * | 3/1978 | Levy et al. | 29/428 |
| 4,153,246 | A | * | 5/1979 | Byrne | 473/197 |
| 4,183,524 | A | * | 1/1980 | Kifferstein et al. | 473/197 |
| 4,659,090 | A | * | 4/1987 | Kustanovich | 273/376 |
| 5,007,645 | A | * | 4/1991 | Weigl et al. | 473/197 |
| 5,116,056 | A | * | 5/1992 | Schmutte | 473/197 |
| 5,277,430 | A | | 1/1994 | Naccarato | 273/400 |
| 5,419,549 | A | * | 5/1995 | Galloway et al. | 473/456 |
| 5,505,244 | A | * | 4/1996 | Thumann | 160/23.1 |
| 5,549,302 | A | * | 8/1996 | Lapsker et al. | 473/446 |
| 5,571,266 | A | * | 11/1996 | Nichols | 273/400 |
| 5,664,784 | A | * | 9/1997 | Redlich et al. | 473/197 |
| 5,681,259 | A | * | 10/1997 | August | 600/27 |
| 5,725,444 | A | | 3/1998 | Heden | 473/446 |
| 5,876,291 | A | | 3/1999 | Dubose | 473/197 |
| 5,947,831 | A | * | 9/1999 | McCarthy | 473/197 |
| 5,993,334 | A | * | 11/1999 | McNamara | 473/446 |
| 6,003,583 | A | * | 12/1999 | Lacoste et al. | 160/122 |

FOREIGN PATENT DOCUMENTS

| | | | | |
|---|---|---|---|---|
| CA | 1140180 | | 1/1983 | 273/99 |
| CA | 2118256 | | 4/1996 | A63B 69/00 |
| FR | 2609640 | * | 1/1987 | |

OTHER PUBLICATIONS

Information sheet for GARAGEMATE™, distributed by Superior Door Services, Abbotsford, B.C., Canada, dated prior to May 1, 1996.

* cited by examiner

*Primary Examiner*—Mark S. Graham
(74) *Attorney, Agent, or Firm*—Davis & Bujold, P.L.L.C.

(57) ABSTRACT

An apparatus for supporting sport practice targets includes an elongate container having a sidewall defining an interior cavity with an elongate access opening extending through the sidewall to the interior cavity. A roll of flexible sheet material is disposed within the interior cavity of the container. The sheet material displays one or more graphics depicting sport practice targets. The sheet material has an extended position in which the sheet material extends through the access opening so that the graphics of sport practice targets are visible and a retracted position in which all but a remote peripheral edge of the roll of sheet material is retracted within the container. The sheet of material can be rapidly moved to the extended position for use and just as rapidly moved to the retracted position for storage.

12 Claims, 6 Drawing Sheets

APPARATUS FOR SUPPORTING SPORT PRACTICE TARGETS

FIELD OF THE INVENTION

The present invention relates to an apparatus for supporting sport practice targets.

BACKGROUND OF THE INVENTION

There are a variety of apparatus for supporting sport practice targets, each of which consist of a sheet of flexible material which is secured to a support structure. The following patents are examples of such apparatus: CA 1,140,180, CA 2,118,256, U.S. Pat. No. 5,277,430, and U.S. Pat. No. 5,876,291. This type of apparatus can be used with any type of sport that involves propelling a projectile at a target area, such as baseball, soccer, golf, and hockey. Mounted on the sheet of flexible material are targets appropriate to the selected sport. CA 2,118,256 is intended for hockey practice and illustrates as a target a hockey goalie. U.S. Pat. No. 5,876,291 is intended for golf practice and illustrates a fairway with a distant green serving as the target. There are a variety of support structures that could be used to support such an apparatus. One commonly depicted is a garage door opening. The reason for this is that a garage door opening is available in many homes and is of a size that will accommodate targets for most sports activities.

The problem with the sports practice apparatus, as describe above, is that they are time consuming to mount to the selected support structure. They, typically, have grommets that enable them to be tied in place around their peripheral edges with ties. More often than not, a father only has a brief window of opportunity of twenty or thirty minutes to play hockey on the driveway with his children or hit a few practice golf balls. When the window of opportunity for sports practice presents itself, it is not practical if the sports practice apparatus takes ten minutes to mount to the support structure. It is even worse when the support structure is the garage door opening, for the another ten minutes must be spent in taking the sports practice apparatus down so it does not obstruct the garage door opening.

SUMMARY OF THE INVENTION

What is required is an apparatus for supporting sport practice targets that can be rapidly positioned on a support structure for use and just as rapidly taken down.

According to the present invention there is provided an apparatus for supporting sport practice targets which includes an elongate container having a sidewall defining an interior cavity with an elongate access opening extending through the sidewall to the interior cavity. A roll of flexible sheet material is disposed within the interior cavity of the container. The sheet material displays one or more graphics depicting sport practice targets. The sheet material has an extended position in which sheet material extends through the access opening so that the graphics of sport practice targets are visible and a retracted position in which all but a remote peripheral edge of the roll of sheet material is retracted within the container. A mounting is provided which is adapted for mounting the container to a support structure.

With the apparatus, as described above, the sport practice targets may be rapidly deployed by pulling the sheet material to the extended position. The sport practice target may be just as rapidly put away by returning the sheet material to the retracted position. In many families both the father and the mother work. The apparatus for supporting sport practice targets, described above, can easily be deployed by children or their babysitters. The apparatus may be mounted on the support structure, thereby eliminating the need to pull the apparatus from storage everytime it is to be used. It is preferred that the manner of mounting include a mounting bracket to secure the remote peripheral edge of the roll of sheet material. It is also preferred that the roll of sheet material be biased toward the retracted position, as such biasing will tend to keep the sheet of material taut during use.

Although beneficial results may be obtained through the use of the sport target apparatus, as described above, even more beneficial results may be obtained when a sensor is embedded in the sheet material in the vicinity of each of the graphics depicting a sport practice target. The sensor is connected to a strike indicator adapted to emit either an auditory tone or a visual signal when one of the graphics of a sport practice target is struck by a projectile. This feature gives the person practicing feedback on performance in the form of positive reinforcement.

Although beneficial results may be obtained through the use of the sport target apparatus, as described above, even more beneficial results may be obtained when the sheet material is reversible and graphics depicting practice targets for different sports are displayed on the different sides of the sheet material.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
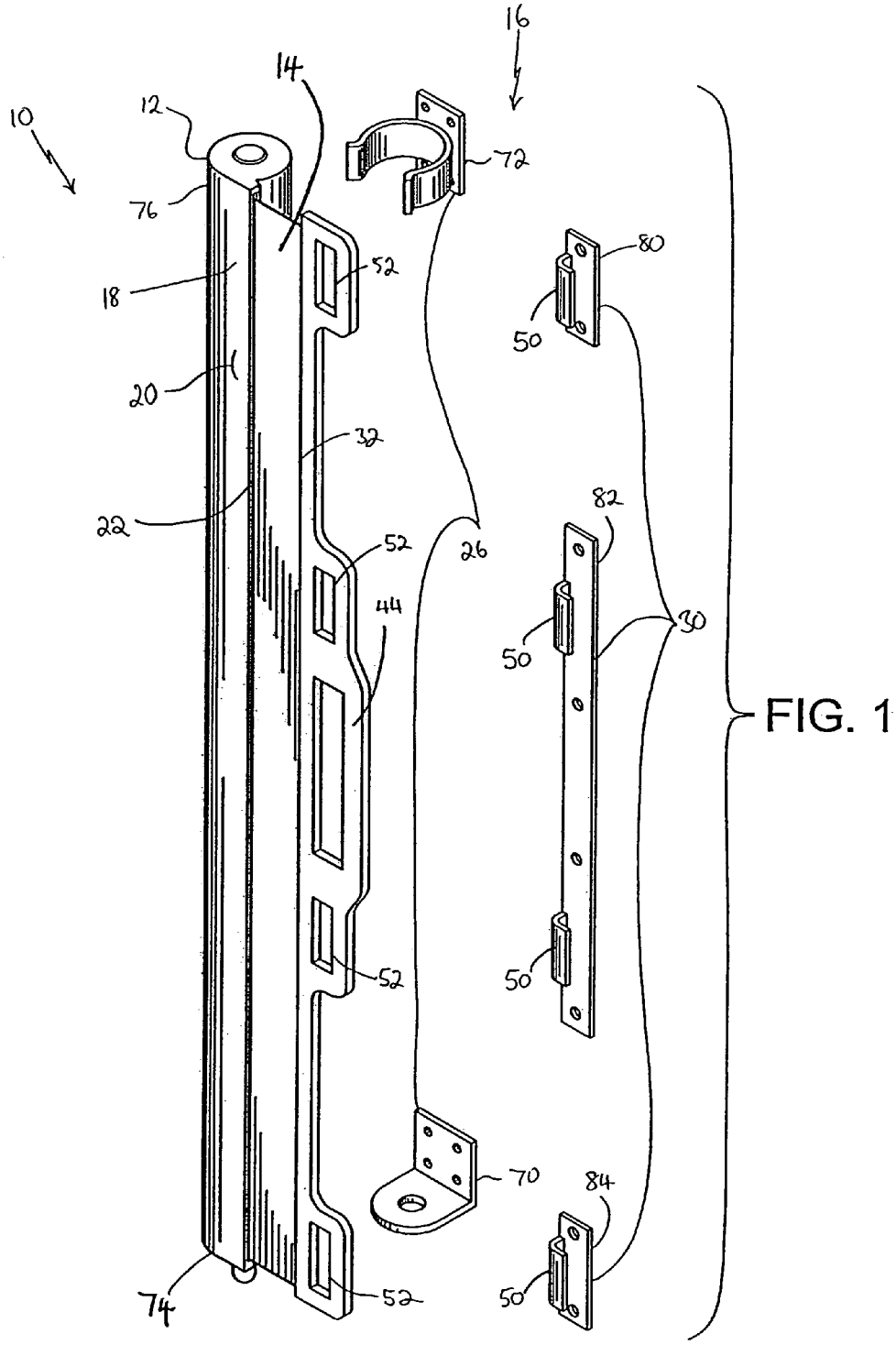
FIG. 1 is an exploded perspective view of an apparatus for supporting a sports practice target constructed in accordance with the teachings of the present invention.

The preferred embodiment, an apparatus for supporting sports practice targets generally identified by reference numeral 10, will now be described with reference to FIGS. 1 through 7.

Figure 4:
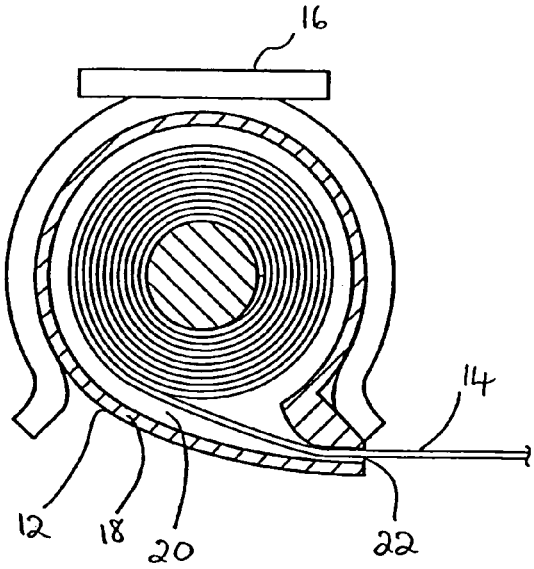
FIG. 4 is a top view in section of an elongate container for the apparatus for supporting sports practice targets shown in FIG. 2, with the roll of sheet material disposed therein.

Referring to FIG. 1, apparatus 10 includes an elongate container 12, a roll of flexible sheet material 14, and a mounting 16. Container 12 has a sidewall 18 defining an interior cavity 20 with an elongate access opening 22 extending through sidewall 18 to interior cavity 20. Referring to FIG. 4, roll of flexible sheet material 14 is disposed within interior cavity 20 of container 12.

Figure 2:
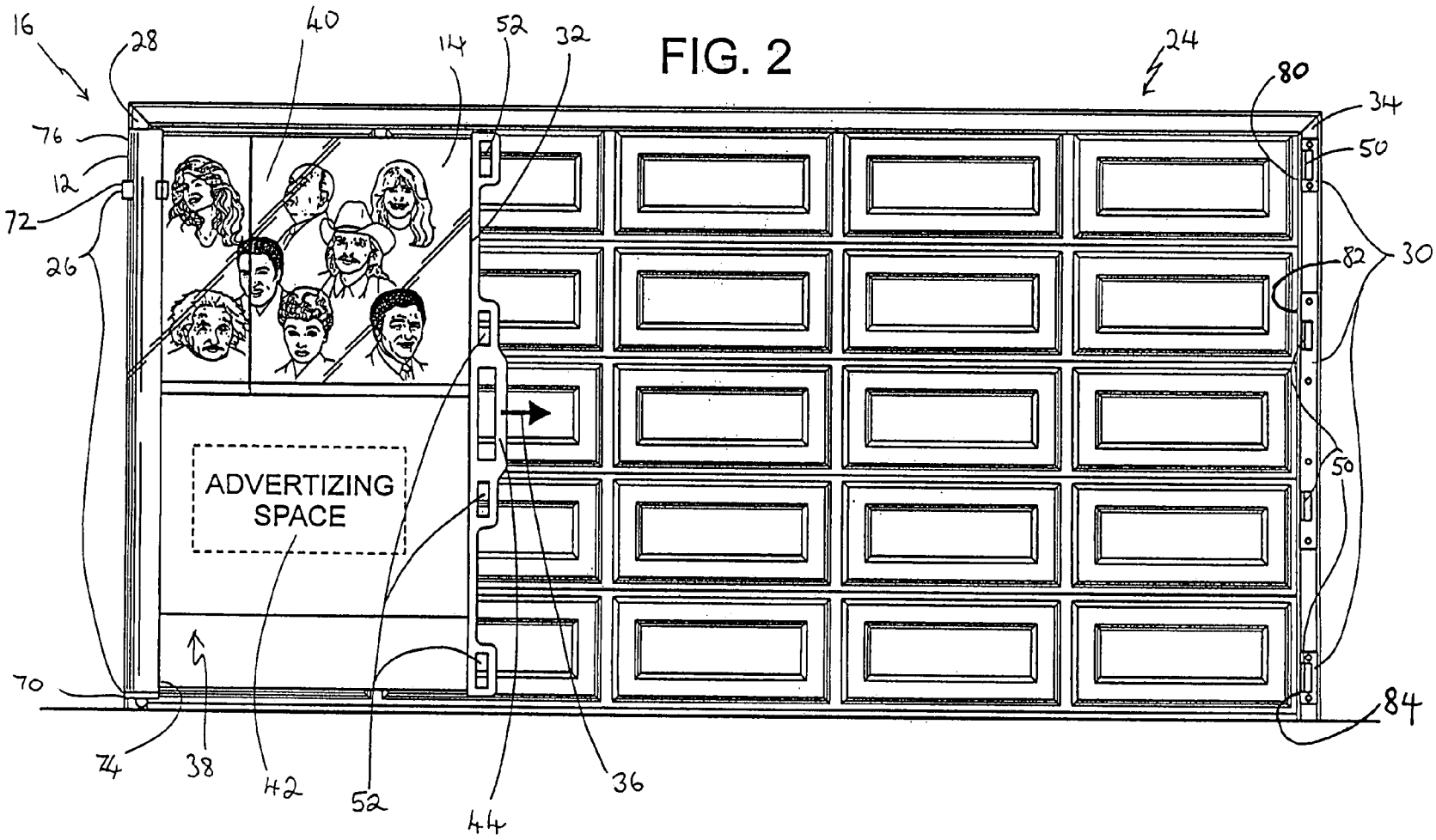
FIG. 2 is a front elevation view of an apparatus for supporting sports practice targets, with the sheet material in the process of being deployed.
Figure 3:
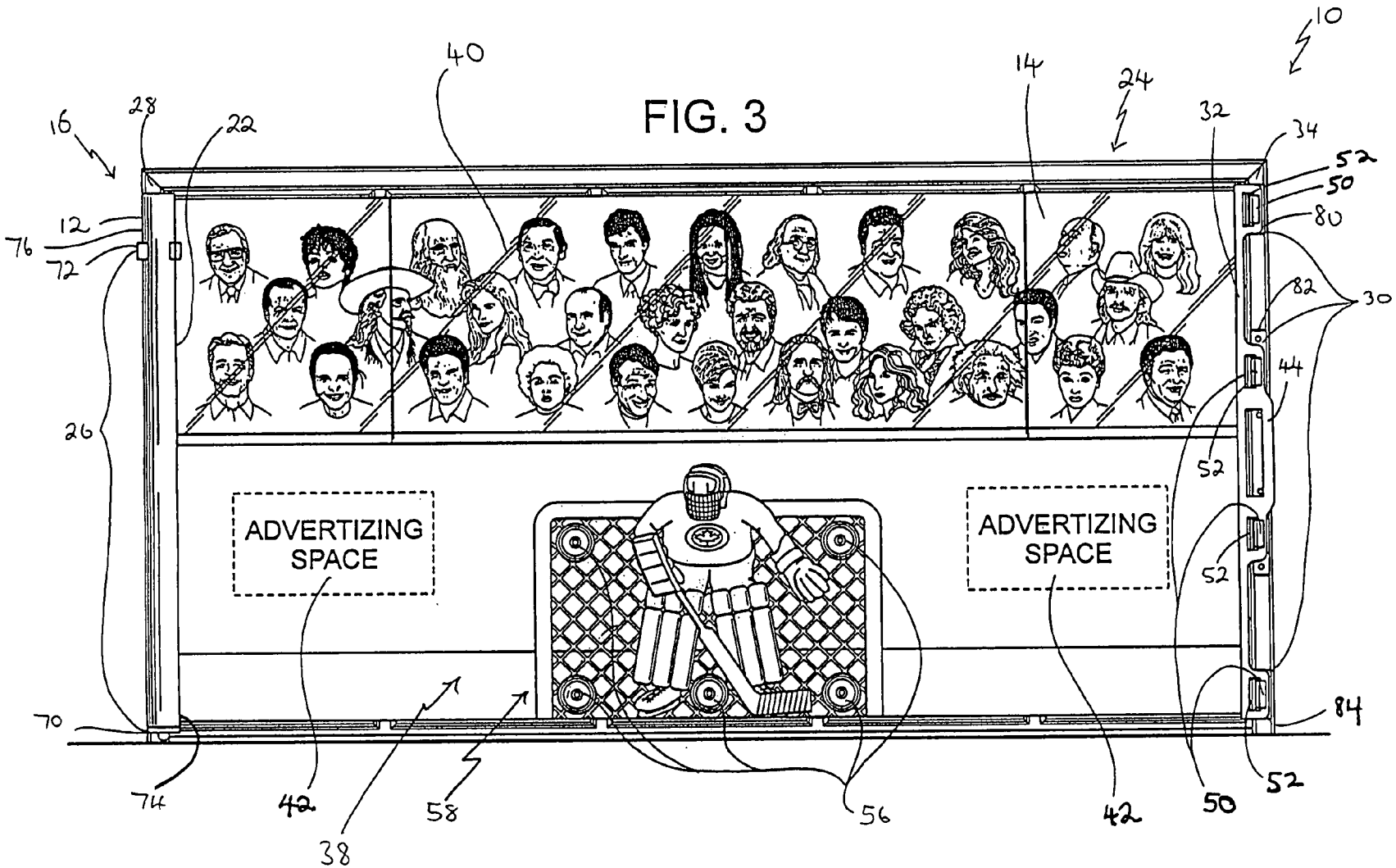
FIG. 3 is a front elevation view of the apparatus for supporting sports practice targets shown in FIG. 2, with the sheet material in the fully deployed position.
Figure 5:
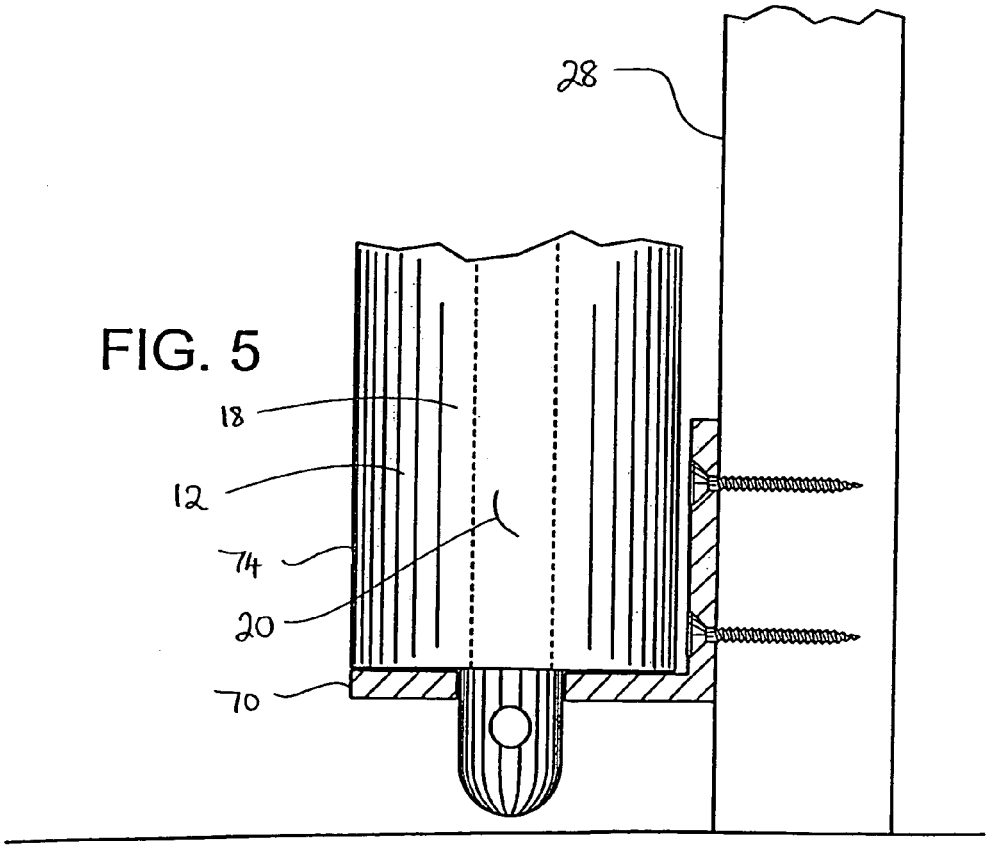
FIG. 5 is a side view of the elongate container supported by the first mounting bracket for the apparatus for supporting sports practice targets shown in FIG. 2, secured to a support.

Referring to FIGS. 2 and 3, mounting 16 is adapted for mounting container 12 to a support structure 24. Mounting 16 includes a first mounting bracket 26 adapted to secure container 12 in a vertical orientation to a first vertical support 28. Referring to FIG. 1, the illustrated embodiment of first mounting bracket 26 has a supporting member 70 and a spring-clip like securing member 72 spaced apart from each other. Referring to FIG. 5, supporting member 70 detachably underlies and supports a first end 74 of container 12. Referring to FIGS. 2 and 3, securing member 72 engages a second end 76 of container 12 to maintain container 12 in a position extending substantially vertically above supporting member 70. It will be recognized that alternative types of first mounting bracket 26 can be used. A second mounting bracket 30 is adapted to secure a remote peripheral edge 32 of roll of sheet material 14 to a second vertical support 34, as illustrated in FIG. 3. Referring to FIG. 1, the embodiment of second mounting bracket 30 illustrated has an upper member 80, a central member 82, and a lower member 84 spaced apart from each other. It will be recognized that alternative types of second mounting bracket 30 can be used. Second mounting bracket 30 has a plurality of male securing members 50 that engage a matching plurality of female securing members 52 along remote peripheral edge 32 to secure sheet material 14 in the extended position to second vertical support 34. It will be recognized that, alternatively, second mounting bracket 30 can have plurality of female securing members 52 and male securing members can be mounted along remote peripheral edge 32. For purposes of illustration, in FIGS. 2, 3 and 6 first vertical support 28 is a first side of a garage door opening and second vertical support 34 is a second side of the garage door opening.

Sheet material 14 is reversibly withdrawn from container 12 by a handle 44 in a direction indicated by arrow 36 as illustrated in FIG. 2, from a fully retracted position in which all but remote peripheral edge 32 of roll of sheet material 14 is retracted within container 12, to a fully extended position in which sheet material 14 extends through access opening 22, as shown in FIG. 3. Sheet material 14 displays graphics 38 showing a sports practice target 58, exemplified by a hockey goalie as illustrated in FIG. 3. When sheet material 14 is in the extended position, the graphics 38 are visible. Optionally, a sports scene 40 and advertisements 42 may also be displayed on sheet material 14. Optionally, sheet material 14 is reversible, graphics 38 on one of the sides being different from graphics 38 on the other of the sides, thereby readily allowing apparatus 10 to be used for the practice of more than one sport.

A biasing spring (not shown) is mounted within container 12, whereby sheet material 14 is biased to the retracted position. Referring to FIG. 2, sheet material 14 is withdrawn from container 12 against the biasing force. Referring to FIG. 3, sheet material 14 is maintained in a taut state by the biasing spring when in the fully extended position. The biasing spring also ensures that sheet material 14 is readily retracted into container 12 when remote edge 32 is released from second mounting bracket 30.

Figure 6:
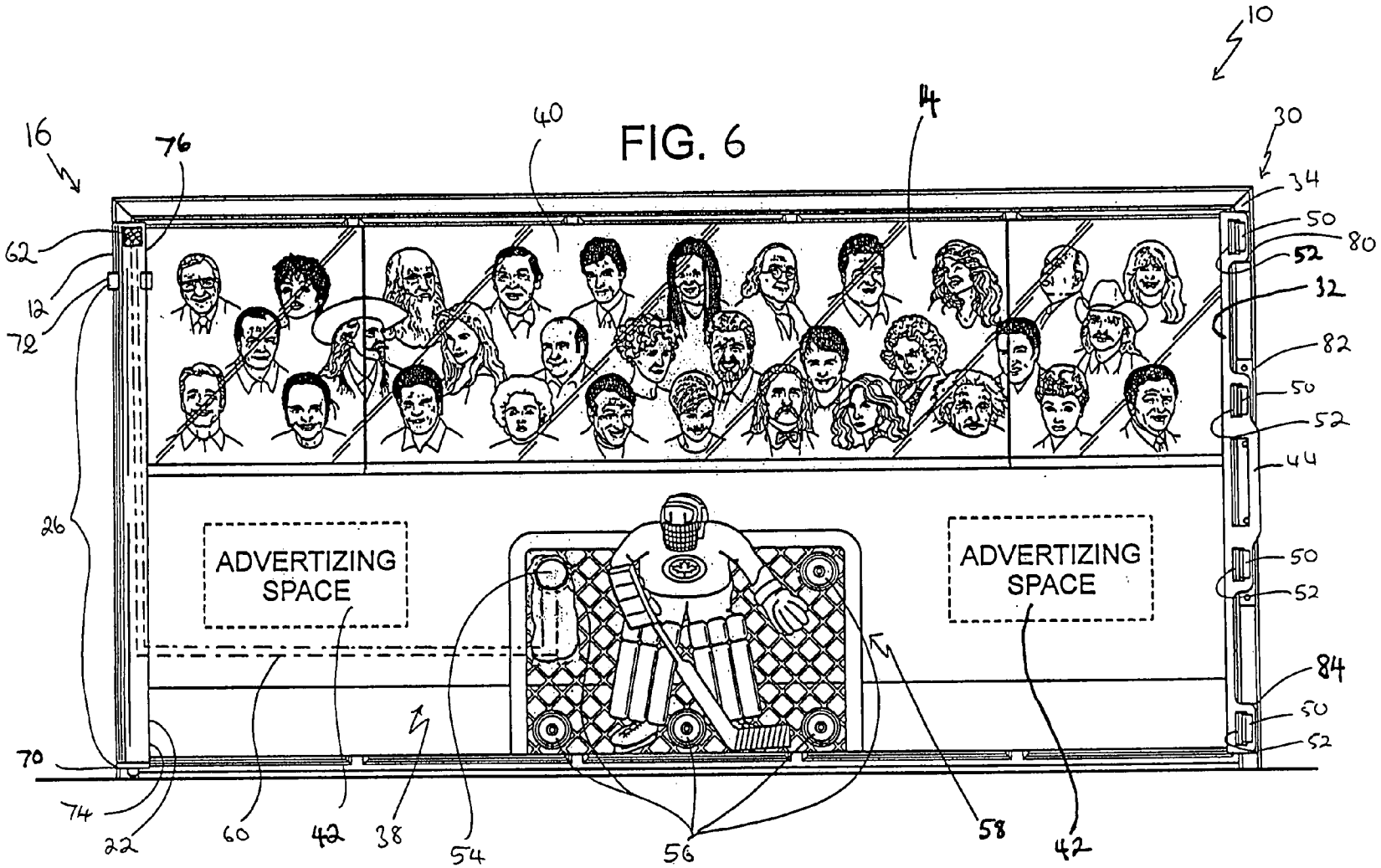
FIG. 6 is a front elevation view, in partial cutaway, of the apparatus for supporting sports practice targets with the sheet material in the fully deployed position as shown in FIG. 3, with the sheet material having embedded therein a sensor connected to a strike indicator adapted to emit one of an auditory tone and a visual signal when a graphic of a sport practice target is struck by a projectile.
Figure 7:
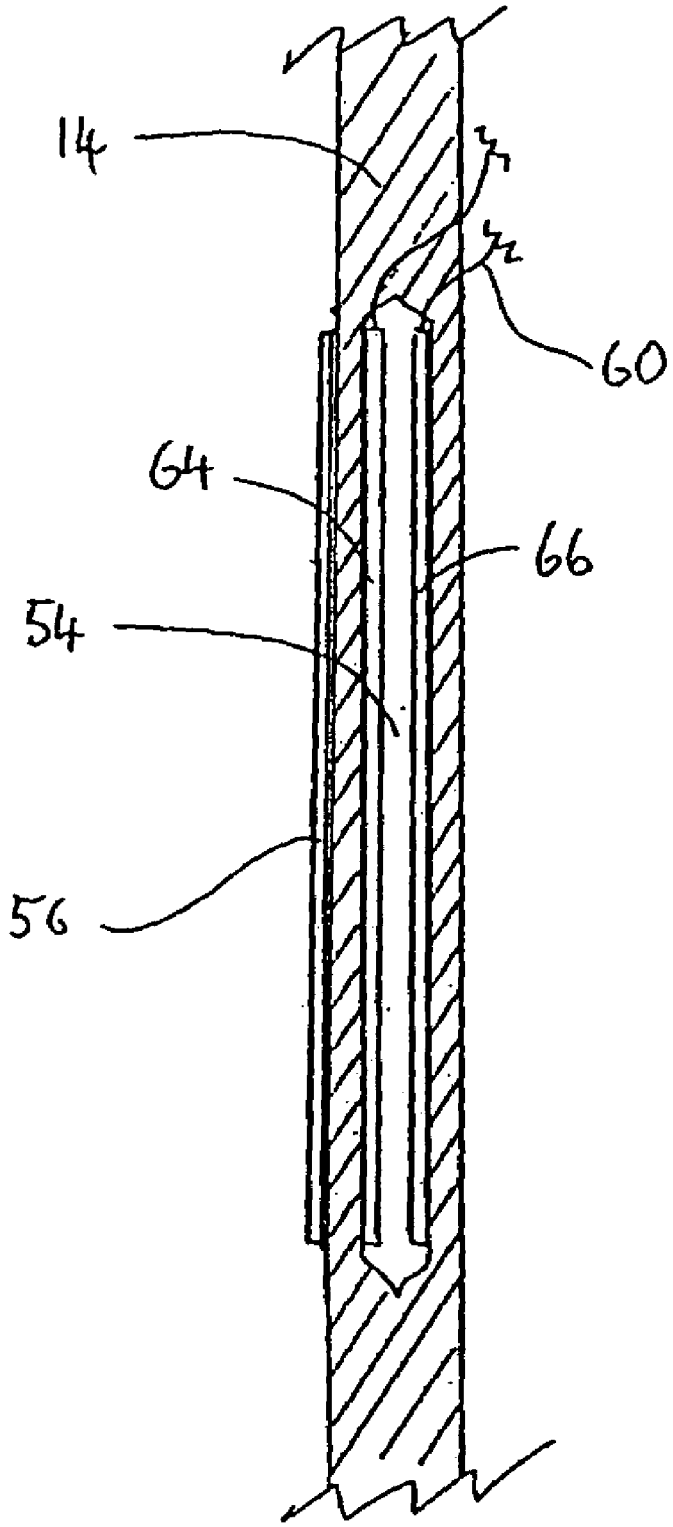
FIG. 7 is a side view of a sensor embedded within the sheet material as shown in FIG. 6.

Referring to FIG. 7, sensors 54 optionally are embedded in sheet material 14 in the vicinity of target portions 56 of the sport practice target 58 of the graphics 38. Referring to FIG. 6, sensors 54 are connected by an electronic circuit 60 to a strike indicator 62. Strike indicator 62 is adapted to emit one of an auditory tone and a visual signal when one of the target portions 56 is struck by a projectile (not shown). Referring to FIG. 7, the illustrated embodiment of sensor 54 is an electronic sensor comprising a first electrical contact 64 and a second electrical contact 66 connected in electrical circuit 60. When target 56 is struck by a projectile (not shown), first electrical contact 64 is resiliently deformed to contact second electrical contact 66, thereby completing electrical circuit 60. Referring to FIG. 6, an electrical signal is transmitted from sensor 54 to strike indicator 62, and either an auditory tone or visual signal is emitted to indicate a strike. When first electrical contact 64 resiliently moves out of contact with second electrical contact 66, circuit 60 is broken and the signal is no longer emitted.

It will be apparent to one skilled in the art that modifications may be made to the illustrated embodiment without departing from the spirit and scope of the invention as hereinafter defined in the claims.

What is claimed is:

1. An apparatus for supporting sport practice targets, comprising:

an elongate container having a sidewall defining an interior cavity with an elongate access opening extending through the sidewall to the interior cavity;

a roll of flexible sheet material disposed within the interior cavity of the container, the sheet material displaying at least one graphic of a sport practice target, the sheet material having an extended position in which the sheet material extends through the access opening so that the at least one graphic of a sport practice target is visible and a retracted position in which all but a remote peripheral edge of the roll of sheet material is retracted within the container, and the flexible sheet material being of a size sufficient to cover an opening for an overhead garage door and of a material able to withstand a plurality of repeated impacts from projectiles, selected from the group comprising a hockey puck, a golf ball, a football, a soccer ball, a baseball, and a softball; and a mounting adapted for mounting the container to a support structure.

2. The apparatus as defined in claim 1, wherein a sensor is embedded in the sheet material in the vicinity of the at least one graphic of a sport practice target, the sensor being connected to a strike indicator adapted to emit one of an auditory tone and a visual signal when the at least one graphic of a sport practice target is struck by a projectile.

3. The apparatus as defined in claim 1, wherein the sheet material has a background graphic that depicts a sports scene.

4. The apparatus as defined in claim 3, wherein the sports scene includes advertisements promoting products or services of third parties.

5. The apparatus as defined in claim 1, wherein the mounting includes a first mounting bracket adapted to secure the container in a vertical orientation to a first vertical support and a second mounting bracket adapted to secure the remote peripheral edge of the roll of sheet material to a second vertical support.

6. The apparatus as defined in claim 5, wherein the first vertical support is a first side of a garage door opening and the second vertical support is a second side of the garage door opening.

7. The apparatus as defined in claim 1, wherein the sheet material is biased toward the retracted position.

8. An apparatus for supporting sport practice targets, comprising: an elongate container having a sidewall defining an interior cavity with an elongate access opening extending through the sidewall to the interior cavity:

a roll of flexible sheet material disposed within the interior cavity of the container, the sheet material displaying at least one graphic of a sport practice target, the sheet material having an extended position in which the sheet material extends through the access opening so that the at least one graphic of a sport practice target is visible and a retracted position in which all but a remote peripheral edge of the roll of sheet material is retracted within the container, and the flexible sheet material being of a size sufficient to cover an opening for an overhead garage door and of a material able to withstand repeated impacts from projectiles; and a mounting adapted for mounting the container to a support structure;

the sheet material has a first side with several graphics of sport practice targets for a first sport and a second side with several graphics graphic of sport practice targets for a second sport.

9. An apparatus for supporting sport practice targets, comprising:

an elongate container having a sidewall defining an interior cavity with an elongate access opening extending through the sidewall to the interior cavity;

a roll of flexible sheet material disposed within the interior cavity of the container, the sheet material displaying a graphic of a sports scene with several sport practice targets, the sheet material having an extended position in which the sheet material extends through the access opening so that the graphic of the sports scene with the several sport practice targets are visible and a retracted position in which all but a remote peripheral edge of the roll of sheet material is retracted within the container, the sheet material beings biased toward the retracted position;

sensors embedded in the sheet material in the vicinity of the sport practice targets, the sensors being connected to a strike indicator adapted to emit one of an auditory tone and a visual signal when anyone of the sport practice targets is struck by a projectile; and a mounting adapted for mounting the container to a support structure, the mounting including a first mounting bracket adapted to secure the container in a vertical orientation to a first vertical support and a second mounting bracket adapted to secure the remote peripheral edge of the roll of sheet material to a second vertical support.

10. The apparatus as defined in claim 9, wherein the sports scene includes advertisements promoting products or services of third parties.

11. The apparatus as defined in claim 9, wherein the first vertical support is a first side of a garage door opening and the second vertical support is a second side of the garage door opening.

12. The apparatus as defined in claim 9, wherein the sheet material has a first side with a graphic depicting a first sport with several sport practice targets appropriate for the first sport and a second side with a graphic depicting a second sport with several sport practice targets appropriate for the second sport.

* * * * *